United States Patent [19]

Morton

[11] 4,033,712

[45] July 5, 1977

[54] FUEL SUPPLY SYSTEMS

[75] Inventor: Scott A. Morton, Laramie, Wyo.

[73] Assignee: Edmund D. Hollon, Douglas, Wyo. ; a part interest

[22] Filed: Feb. 26, 1976

[21] Appl. No.: 661,629

[52] U.S. Cl. ..... 431/90; 137/98; 431/12

[51] Int. Cl.[2] ..... F23H 3/00

[58] Field of Search ..... 431/12, 90, 75; 137/98, 137/6

[56] References Cited

UNITED STATES PATENTS

| | | | |
|---|---|---|---|
| 3,236,449 | 2/1966 | Brunner | 431/12 X |
| 3,592,574 | 7/1971 | Zenkner | 431/90 |
| 3,602,487 | 8/1971 | Johnson | 431/12 X |
| 3,797,989 | 3/1974 | Gordon | 431/90 |
| 3,973,898 | 8/1976 | Seider | 431/12 X |

*Primary Examiner*—Edward G. Favors
*Attorney, Agent, or Firm*—Hugh H. Drake

[57] ABSTRACT

A combustion apparatus has an exhaust system, a fuel-supply system, and an air-supply system. The ratio of fuel-to-air supplied to the apparatus is adjustable in either direction in response to control information. A temperature signal is developed which has a value proportional to the combustion-produced temperature. A first sample of that temperature signal selected during a first time interval is compared with a second sample of the temperature signal developed during a later time interval. The comparison serves to produce the control information that causes adjustment of the fuel-to-air ratio in the direction seeking a maximum of combustion-produced temperature. Digital logic circuitry is specifically utilized for the purpose of producing the desired control information.

12 Claims, 4 Drawing Figures

FUEL SUPPLY SYSTEMS

The present invention pertains to fuel supply systems. More particularly, it relates to systems for adjusting the ratio of fuel to air supplied to combustion apparatus, the adjustment being in an amount to achieve maximum fuel economy and related completeness of combustion.

A wide variety of fuel supply systems for combustion apparatus have been devised in seeking a goal of increased fuel economy and/or a decrease in unwanted combustion products emitted from the exhaust system. In general, the prior approaches have involved sampling one or more of a variety of operating or conditioning parameters and adjusting one or more fuel supply variables in a manner dependant upon the sampled information. The operating parameters or conditions sensed have included the heat conductivity characteristic of the exhaust gases, the exhaust gas temperature, the oxygen partial pressure in the exhaust system, the thermal conducting of those gases, carbon monoxide and oxygen present in the exhaust gases, ambient intake air temperature, intake air humidity, barometric pressure and the analyzed composition of the exhaust gases. In response to such information, either fuel and/or air supply rates have been adjusted. In at least many of these prior approaches, either the sensing and/or the adjusting mechanisms result in undesired additional expense and complexity.

One particular prior approach has involved a system which responds to exhaust gas temperature for increasing the fuel supply in proportion to an increase in that temperature. A decrease in the temperature similarly decreases the amount of fuel supplied. Thus, the fuel/air ratio is varied as a function of exhaust gas temperature. To achieve adjustment of the ratio, that system continually compares a temperature-represented voltage with a voltage that is proportional to the operating speed of the fuel pump. The comparison signal is then utilized to control the instantaneous fuel pump speed and thereby control the instantaneous rate of fuel flow. While this approach seems worthwhile, it is at least undesirably complex in its requirement of a variable-speed pump and some kind of device, such as tactometer generator, for developing a voltage which is proportional to that speed.

It is, accordingly, a general object of the present invention to provide a new and improved fuel system which overcomes the problems of excess cost, complexity and the like in prior such systems including those adverted to above.

Another object of the present invention is to provide a new and improved fuel system which enables increased fuel economy.

A further object of the present invention is to provide a new and improved fuel system which achieves decreased unwanted emission of combustion products from the exhaust system.

Still another object of the present invention is to provide a new and improved arrangement for adjusting the fuel/air ratio supplied to a combustion apparatus.

The invention is thus directed to combustion apparatus that has an exhaust system, a fuel supply system and an air supply system. The improvement includes varying means responsive to control information for adjusting in either direction the ratio of fuel to air supplied to the apparatus. Detecting means responsive to the atomosphere within the combustion system senses the temperature of the combustion result and develops a temperature signal that has a value proportional to that temperature. Also includes are means for successively comparing a first sample of the temperature developed during a first time interval with a second sample of the temperature signal developed during a later time interval to produce the control information and thereby enable the varying means in the direction seeking a maximum of combustion result.

For achieving adjustment of the fuel-to-air ratio, the system preferably also includes impelling means in the fuel supply system for delivering that fuel under pressure. A feedback means serves to return fuel along a path from the output to the input of the impelling means. A successive pair of valves are included in the path. Also included are varying means reponsive to a pressure condition for adjusting the ratio of fuel-to-air supplied to the apparatus. That varying means is coupled to a junction in the feedback path between the valves. Finally, the system includes means responsive to an operating parameter of the apparatus for selectively operating the valves to govern adjustment of the fuel-to-air ratio.

The features of the present invention which are believed to be novel are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
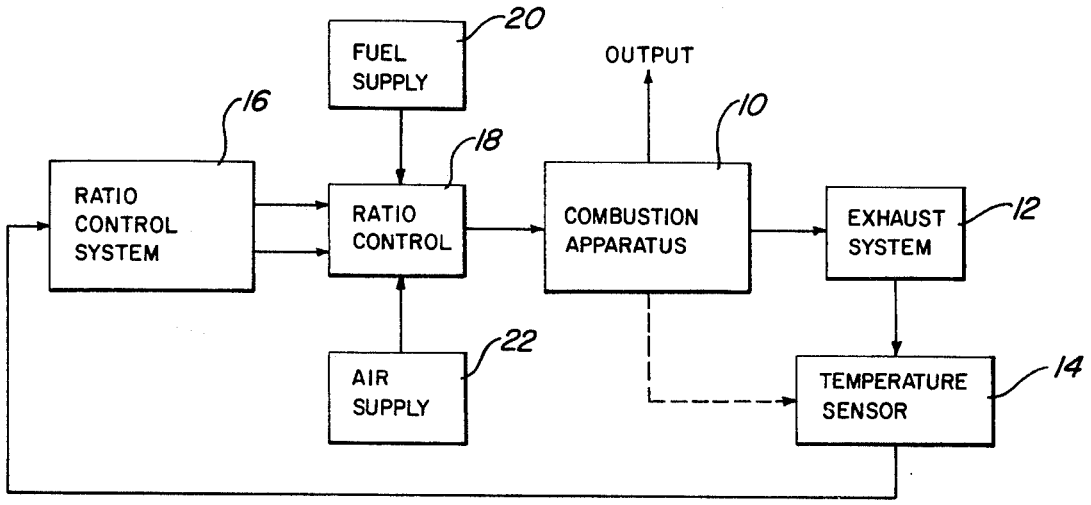
FIG. 1 is a block diagram of combustion apparatus.

In FIG. 1, combustion apparatus 10 feeds its gaseous production products through an exhaust system 12. A temperature sensor 14 detects the instantaneous exhaust gas temperature (EGT) and develops a temperature signal in the form of a voltage that has a value proportional to the EGT. A ratio control system 16 successively compares a first sample of the temperature signal developed during a first time interval with a second sample of that temperature signal developed during a later time interval to produce control information. That information is fed to a ratio control 18. Ratio control 18 receives fuel, such as oil, gas or gasoline, from a fuel supply 20 and air from an air supply 22. In response to the control information from ratio control system 16, ratio control 18 adjusts the fuel-to-air ratio supplied to apparatus 10. Ratio control system 16 serves to enable ratio control 18 in the direction that seeks a maximum of EGT as detected by temperature sensor 14. In principle, ratio control 18 may serve to adjust the ratio of flow of either fuel or air supplied to apparatus 10, or it may control both of those rates of flow. Moreover, it is not significant for purposes of utilizing the present invention whether the resultant fuel mixture is conveyed to the apparatus by means of a carburetor, fuel injection system or otherwise. Still further, combustion apparatus 10 might serve its purpose in connection with any of a variety of kinds of utilization. For example, it may be part of a forced-air furnace, a boiler or an internal combustion engine. In use as a furnace or boiler, the aforementioned term "exhaust gas temperature" refers either to the so-called stack temperature or to the temperature at the point of most heating importance such as that at the input to a heat exchanger; in a system that employs a flame, it may even be the maximum flame temperature, In any case, all reference is to what may be termed the combustion-produced temperature; the aim is to maximize that value.

Without departing from the intended generality of the foregoing, the apparatus will now be more specifically described as employed in connection with an internal-combustion engine. Preferably, such an engine is utilized in stationary service for supplying motive power to a continuously-running machine such as a generator or a conveyor imposing a somewhat constant load. While the improvements herein disclosed seen to be attractive as applied to automotive engines, further improvement in response time appears to be desirable in that general application. However, the system as now described is contemplated as being directly applicable, even in that application, to usage in fuel injection systems individually applied to each cylinder of an internal combustion engine.

Figure 2:
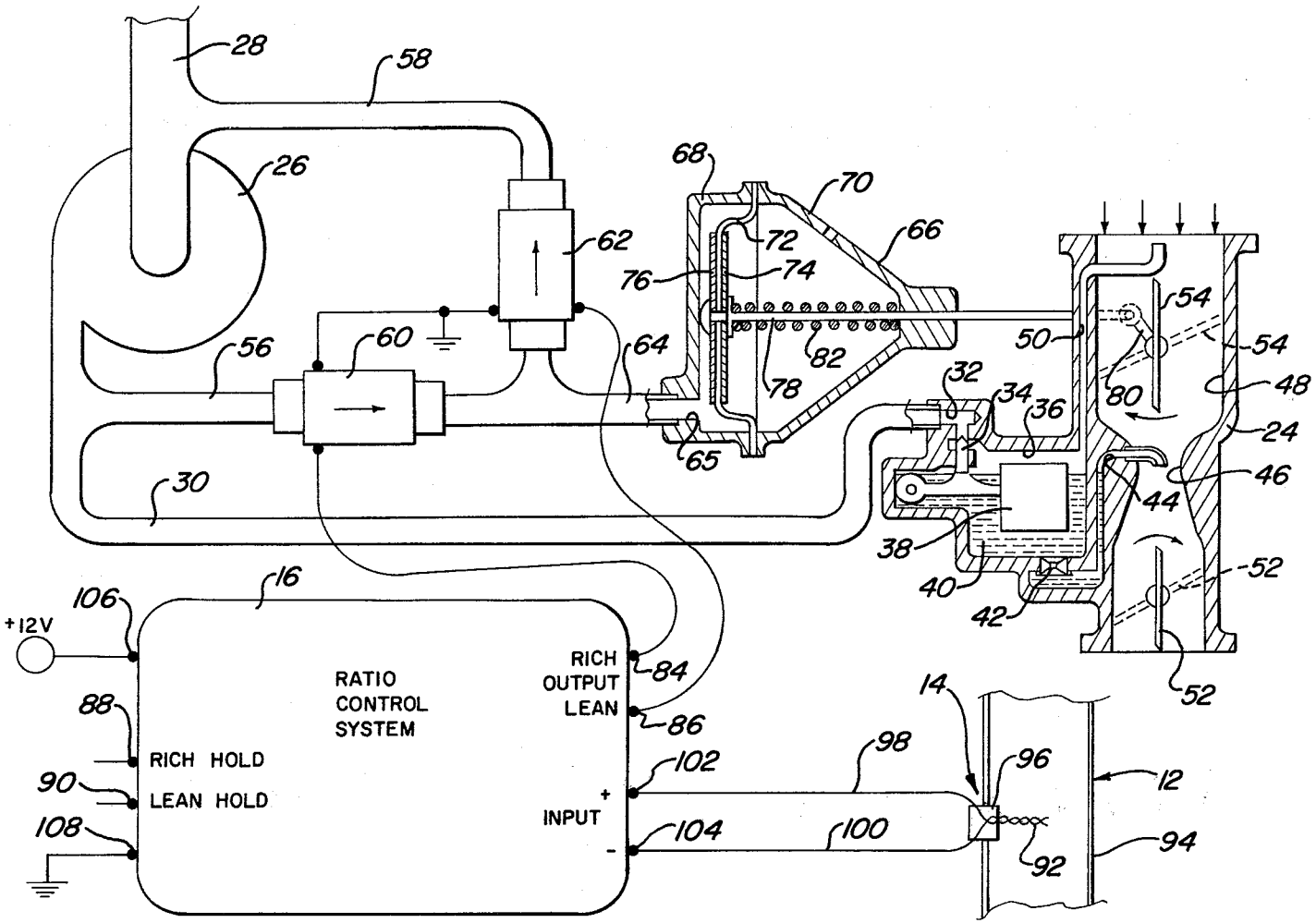
FIG. 2 is a generally schematic representation of a fuel supply system for an internal combustion engine.

As specifically implemented in FIG. 2, therefore, the fuel system incorporates a conventional venturi-type carburetor 24. A fuel pump 26 draws fuel through a line 28 from a fuel tank. The fuel is delivered under pressure from pump 26 through a line 30 to a fuel inlet 32 of carburetor 24. A float-operated needle valve 34 serves to admit the fuel from inlet 32 to a chamber 36. Needle valve 34 is controlled by a float 38 that serves to maintain chamber 36 in a condition in which it is almost filled with fuel 40 under normal operation. Disposed in the bottom wall of chamber 36 is a jet 42 the diameter of which determines the amount of fuel 40, for a given pressure differential between chamber 36 and the throat 46 of carburetor 24, that is discharged from chamber 36 and conveyed through a channel 44 for injection into throat 46. As is well known, chamber 36 may also include a pump linked to the throttle mechanism for causing an increased amount of fuel to be moved through jet 42 and out conduit 44 on the occurance of rather sudden depression of the throttle mechanism as when seeking to accelerate the speed of the engine.

Throat 46 constitutes a necked-down portion of a barrel 48. Ambient air is received into the upper end of barrel 48 in order to mix with the emitted fuel within throat 46, the resultant mixture being conducted out of the bottom of barrel 48 into the customary input manifold of the engine. A conduit 50 leads from the upper end of barrel 48 into the upper portion of chamber 36 for the purpose of maintaining atmospheric air pressure above fuel 40 contained in that chamber. As is conventional, the amount of the resultant fuel mixture supplied to the intake manifold of the engine is controlled by a shutter valve 52 positionable at any desired point between the fully opened position as shown in solid line and the closed position as shown in dashed outline. Similarly situated within the upper end portion of barrel 48 is another shutter-type valve 54 commonly known as a choke. Valve 54 is pivotable between its open position as shown in solid line and in its closed position as represented by dashed outline.

As so far described in regard to FIG. 2, fuel pump 26 and carburetor 24 operate in a conventional and well-known manner. The fuel pump delivers the fuel under pressure to inlet 32 of the carburetor, and the fuel is delivered through conduit 44 into throat 46 so as to thereat mix with the incoming air which travels past choke 54. Closure of choke 54 by any selected degree serves to cause the mixture supplied to the engine, from out of the bottom end of barrel 48, to become what is commonly termed "richer". Valve 52 is the throttle control, adjusting the total quantity of the air-fuel mixture which is introduced into the engine. Departing from the conventional, a feedback loop extends from the outlet to the inlet ends of fuel pump 26. More specifically, a conduit 56 is coupled at one end to the outlet end of pump 26 and leads into a conduit 58 that connects into the inlet end of the fuel pump. A succession of solenoid-actuated valves 60 and 62 are included in the thus-established feedback loop. Coupled into the junction in the feedback path between solenoids 60 and 62 is an additional conduit 64 that permits the delivery of fuel into an inlet 65 of a diaphram actuator 66. Actuator 66 is formed of a pair of mating half shells 68 and 70 that captivate the rim of a flexible diaphram 72. Centrally disposed washers 74 and 76 on opposite sides of the central portion of diaphram 72 are rigidly coupled to one end of a central shaft 78 which extends outwardly through shell 66 and into pivotal connection at its other end with a link arm 80 connected to the central mounting pin of shutter valve 54 so as to be capable of varying the position of the latter. A spring 82, coiled around a portion of shaft 78 disposed within actuator 66, serves to bias diaphram 72 toward half-shell 68 and thereby maintain shutter valve or choke 54 in a fully open position.

With fuel pump 26 in operation, a preselected fuel pressure is maintained within conduit 56 at the input side of the feedback loop. Assuming that valve 62 is closed, a brief opening of valve 60 serves to permit an increase in fuel pressure within conduit 64 and inlet 65. That increased pressure within the inlet side of actuator 66 causes diaphram 72 to move to the right in FIG. 2. Such movement also urges shaft 78 to the right which, in turn and through link arm 80, steps choke valve 54 in the closed direction. If valve 60 is then held in the closed position and valve 62 is opened for a brief interval, both the lower pressure at the inlet of fuel pump 26 and the urging of spring 82 cause fuel previously stored within the inlet side of actuator 66 to return through valve 62 to the inlet side of pump 26. That, in turn, permits diaphram 78 to move to the left in FIG. 2 and causes shaft 78 to swing link arm 80 in a direction stepping choke valve 54 in the open direction. In general, then, valve 60 may be opened to cause choke 54 to close. Alternatively, valve 62 may be the one which is opened to cause choke 54 to open. By operating the valve desired in brief, incremental, steps, the adjustment of the position of choke 54 may likewise be in discrete incremental steps.

Corresponding with the immediate foregoing, ratio control system 16 provides an output signal from a terminal 84 to open valve 60 and thus result in a closing of valve 54 so as to result in a more rich mixture being supplied to the engine. Another output terminal 86 feeds an output signal to valve 62 for the purpose of opening the latter and thereby reversing the direction of movement of valve 54 so as to obtain a leaner mixture. As also indicated in FIG. 2, system 16 has a rich-hold input terminal 88 and a lean-hold input terminal 90. System 16 is arranged so that the supply of an input signal to terminal 88 results in the development of an output signal at terminal 84 so as to open valve 60 and thereby maintain choke valve 54 at least in a position directed towards its closed position so as to sustain the development of a rich mixture fed into the engine. Conversely, the application to terminal 90 of an input signal results in the production at output terminal 86 of a signal that opens valve 62 so as to maintain choke valve 54 in or near its open position and thereby sustain the feed of a lean mixture into the engine.

As further indicated in FIG. 2, temperature sensor 14 simply takes the form of a thermocouple 92 which projects into the exhaust pipe 94 of exhaust system 12. Thermocouple 92 is affixed within the wall of the exhaust pipe and an insulator 96 and has its two output leads 98 and 100 connected to corresponding input terminals 102 and 104 of ratio control system 16. Finally, ratio control system is powered by means of a terminal 106 connected to the positive side of the ordinary twelve-volt battery supply, whereas a terminal 108 is connected by the overall system ground to the negative side of the battery supply. Of course, the other ends of the windings in each of the solenoids 60 and 62 are returned to that same ground as indicated.

Figure 3:
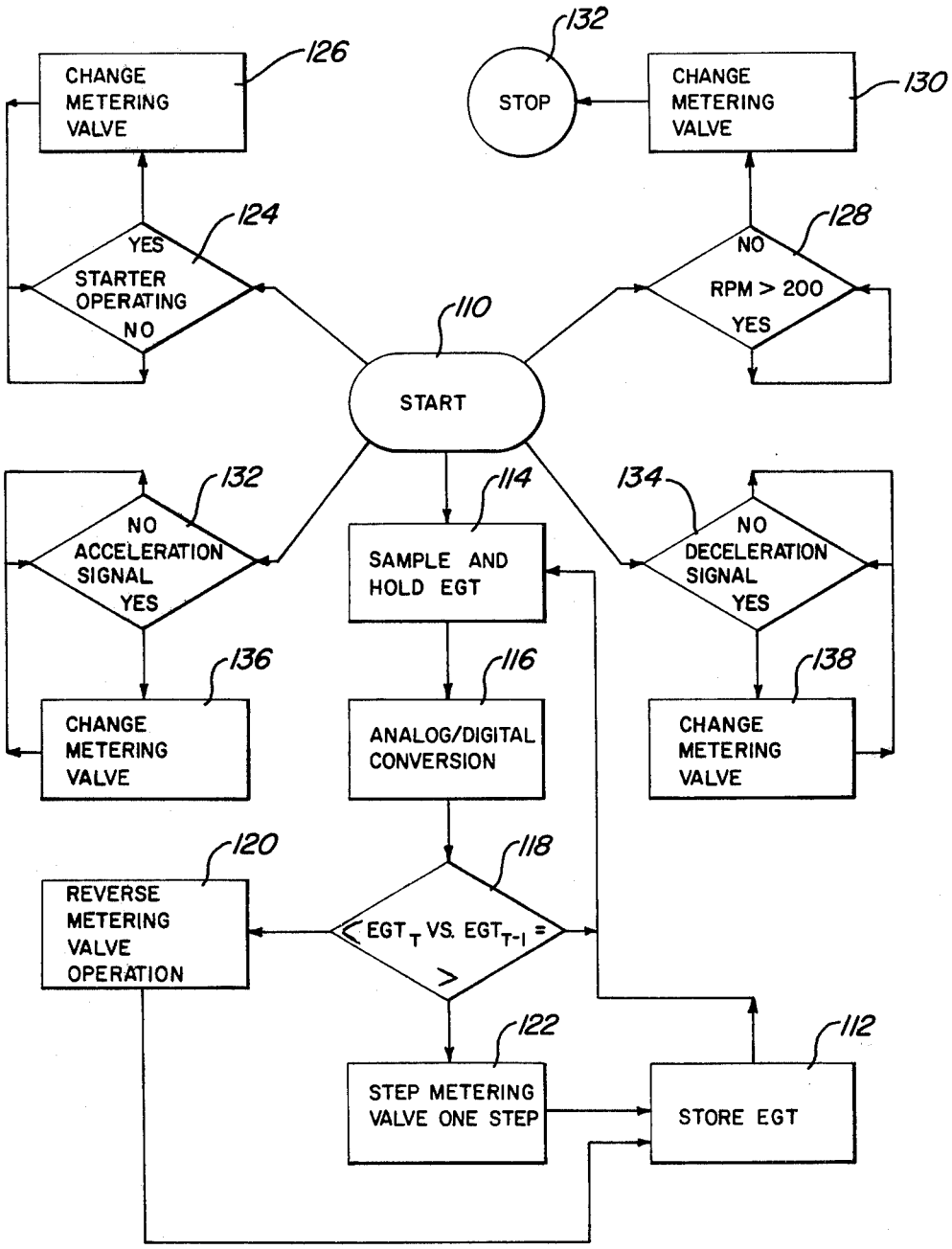
FIG. 3 is a flow chart describing the operation of the system of FIG. 2.

FIG. 3 depicts a flow diagram applicable to an overall system operation. Operation of the system is enabled by the actuation of a start function 110, as for example by a suitable connection established by manipulation of a conventional ignition switch. EGT as determined by temperature sensor 14 is stored as indicated at 112. The stored EGT is then sampled and held as represented at 114. Considering that the type of potential produced by thermocouple 92 is analog by nature, the temperature signal so held at 114 is then converted to digital form as represented at 116. The digital temperature-representative signal so developed then serves as an input to comparing means 118 the function of which is to compare the EGT sampled at a first time interval with the EGT sampled at a later time interval. That is, as indicated in FIG. 3, $EGT_T$ is compared with $EGT_{T-1}$. When the later sample represents less than that of the earlier, indicating that the exhaust gas temperature has dropped, the operation of the metering valve is reversed as indicated at 120. On the other hand, when the comparison indicates that the later sample of the temperature has a valve which is greater than the earlier sample, the metering valve is held in a direction continuing its previous direction of change; this is included within the function shown at 122. Results of the operating function of either units 120 or 122 also supplies an input to EGT store 112 so as to update the information in the latter. Should the comparison being made in comparing unit 118 be such that the temperature in the successive intervals are the same, there is no output to either of metering-control units 120 and 122; instead, an output is directed into the sample and hold unit 114 so as to maintain a continued level condition in the latter.

Of course, metering valve operation or control indication by means of units 120 and 122 is embodied in FIG. 2 by means of control of actuator 66 through selective energization of valves 60 and 62 so as to adjust the position of choke 54. That is, choke 54 is, in this case, the metering valve of the system of FIG. 3. In alternatively contemplated systems, a fuel flow metering valve may be employed.

The overall system may include additional overrides upon the operation of comparing unit 118 and its associated functional units or devices. Thus, a unit 124 serves to detect whether the engine starter is operating. When the answer to that is "yes," a unit 126 is directed to change the metering valve to the desired condition for starting the engine. A unit 128 serves to sense when the speed of the engine is decreased below a certain value such as, for example, that in which its revolutions-per-minute are less than the value of two hundred. When the RPM is not greater than that value, as when idling, a unit 130 serves to change the metering valve to the optimum condition desired for that condition. Although it was previously pointed out that either air supply or fuel supply may be adjusted in response to operation of the ratio control system, the detailed explanation given in connection with FIG. 2 has emphasized control of the air supply. When, however, the control is instead of the fuel supply, the same flow-control type of component system as depicted in FIG. 3 may be utilized. In general, that means that the operation of any particularly illustrated component unit would be the opposite for a fuel supply system as would be the case for an air supply system adjustment. An example of this extension of such differences might well occur in connection with the functioning of units 128 and 130. In the case where it is a fuel supply which is being adjusted, unit 130 might feed a signal to a stop unit 132 which would completely disable the supply of fuel whenever the RPM of the engine is decreased below a preselected value.

As an additional auxiliary subsystem that desirably may be included in the overall arrangement, FIG. 3 depicts a unit 132 that detects the occurrence of acceleration of a vehicle powered by the engine. Similarly included is a unit 134 that detects the reverse condition of deceleration. As previously mentioned, the present apparatus may not exhibit a sufficiently-fast response time for common automotive usage not entailing individual cylinder application. Nevertheless, these change-of-speed controls may prove useful in some environments. When acceleration is not occuring, nothing happens as a result of the function of unit 132. When there is acceleration, on the other hand, metering valve control unit 136 is enabled so as to result in a change of fuel mixture so as to achieve best operation during acceleration as demanded. Analogously, deceleration signal unit 134 operates upon a metering valve control unit 138 so as to change the position of that valve under conditions of deceleration, again for the purpose of obtaining optimum operation under that condition. As already indicated, at least in part, much of the immediate foregoing may not be needed or desired in a given application. For example, any one or more of steps 124–126, 132–136, 134–138 and 136–132 may be excluded in a usage such as that of a stationary engine.

In general with regard to the operation of FIG. 3, the processing of information in digital form by comparator 118 enables it to change the metering valve position one step at a time in a direction controlled by the instantaneously-directed operation of one of units 120 or 122. That direction of change is continued step-by-step until an equality condition, on successive-interval comparisons, is reached. Thereafter, neither of units 120 or 122 is enabled until such time as there is a difference in the comparison of samples obtained during successive time intervals. When that difference again appears, one or the other of units 120 or 122 will be actuated so as to step a change in position of the metering valve in the proper direction in order to continue to seek maximum exhaust gas temperature.

Auxiliary units 124, 128, 132 and 134 all are part of the aforementioned override system. That is, each of those units serves to feed a signal either to terminals 88 or 90 of ratio control system 16 for the purpose of overriding the operation of comparison means 118 and instead directing a fixed positioning of the metering valve at a preselected position.

Figure 4:
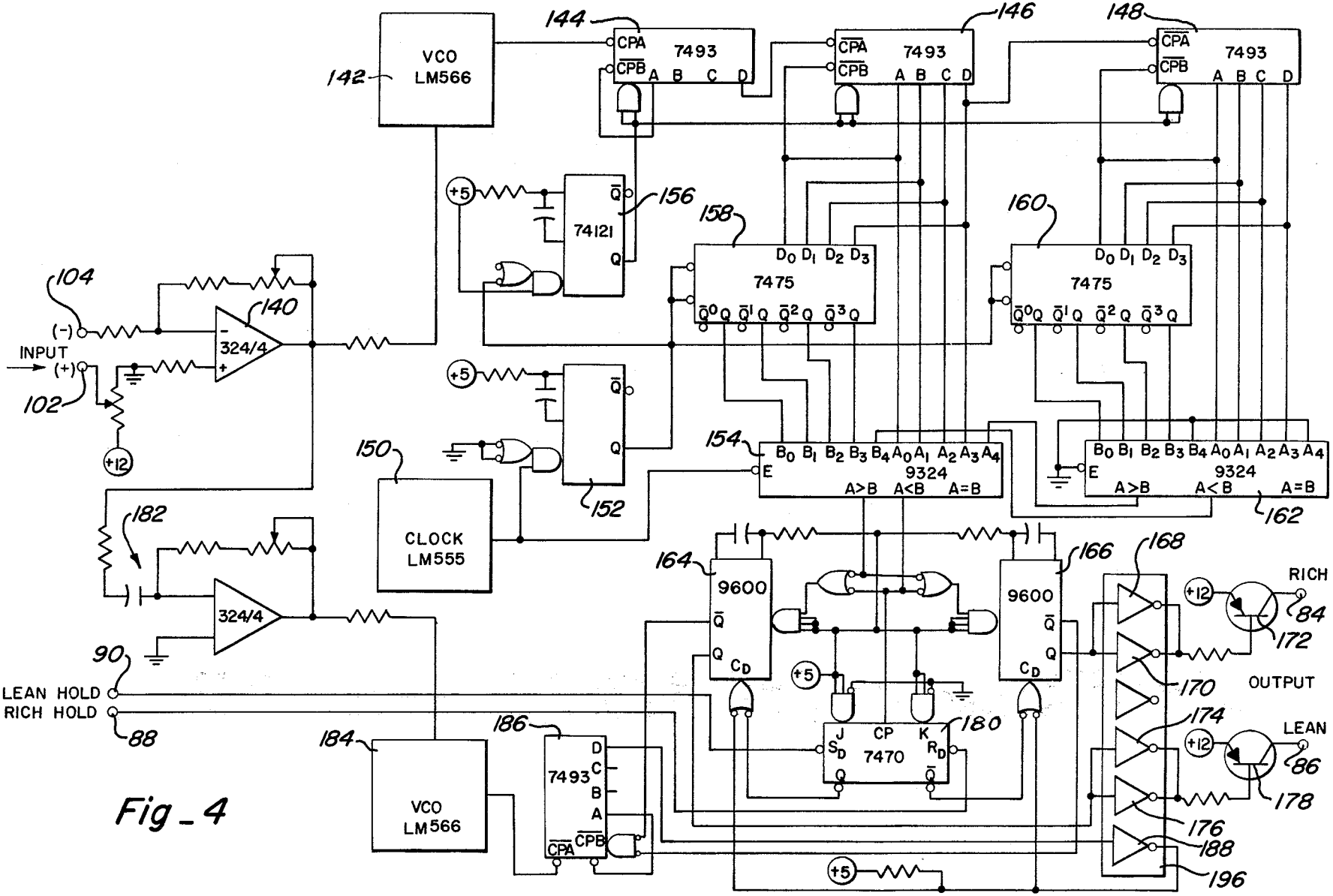
FIG. 4 is a schematic diagram of a logic system implemented within the system of the preceding figures.

As is usual in connection with the implementation of the details of any logic control system, a variety of approaches may be taken for handling and distributing the logic signals. One suitable implementation of ratio control system 16 is shown in FIG. 4. The system of FIG. 4 is, of course, made up of suitably interconnected integrated-circuit units. Each of the different components is labeled in FIG. 4 with the accepted standard numerical nomenclature that indicates its specific type. The terminal-connection letters depicted within the blocks that outline each such component also are standard designations. In more detail, input terminals 102 and 104 are connected to the input terminals of a quad-type operational amplifier 140 of the kind suitable for single-polarity power supply. The output from operational amplifier 140 triggers a voltage controlled-oscillator 142 which, in turn, feeds a four-bit binary counter 144. The latter is connected so as to be able to trigger a subsequent same-type counter 146 which, in turn, triggers still-another counter 148. A clock timer 150 develops a timing signal having a repetition rate such that the period is approximately equal to the time constant of sensor 92 in FIG. 2. In an exemplary system, that is about 1 Hertz. That timing signal serves to enable both a monostable multivibrator 152 and a five-bit comparator 154. Multivibrator 152 also feeds its output information to another monostable multivibrator 156 and a pair of four-bit latches 158 and 160. Multivibrator 156 resets each of counters 144, 146 and 148 to a binary zero count. The count signals from counter 146 are fed to latch 158 and also to comparator 154. Analogously, counter 148 feeds its count signals to latch 160 as well as to still another comparator 162. Additional relative comparison signals are fed into comparator 154 from comparator 162; the pair of increasing-representative or decreasing-representative signals ultimately obtained from the output of comparator 154 are supplied as respective inputs to retriggerable resettable multivibrators 164 and 166. The primary output from multivibrator 166 is fed in parallel through a pair of not-connectives 168 and 170 so as to gate a transistor 172 that produces the ultimately desired rich control information signal at terminal 84. Analogously, a primary output signal from multivibrator 164 is fed through another pair of not-connectives 174 and 176 and serves to gate the operation of a transistor 178 that supplies the control information signal at terminal 86, representing the demand for a leaner condition.

The signals from rich hold terminal 88 and lean hold terminal 90 are supplied as inputs to an edge triggered JK flip-flop 180 which has its outputs suitably coupled to multivibrators 164 and 166 for the purpose of enabling the above-described override function. The input-representative signal developed at the output of differential amplifier 140 also is supplied as an input to a differentiator amplifier circuit 182 which, in turn, feeds a voltage controlled oscillator 184. The output from the latter is supplied as an input to a four-bit binary counter 186 an output of which is suitably coupled to resets on multivibrators 164 and 166 through an additional not-connective 188. As shown, the $\overline{Q}$ outputs of multivibrators 164 and 166 also are connected to counter 186. All of the different not-connectives mentioned are conveniently integrated within a single hexinverter buffer/driver 190.

As will be observed by a person skilled in the art, the circuitry of FIG. 4 effectively integrates over the sampling time interval. That is, it is the equivalent of a more simple, in strict diagram terms, sample and hold arrangement. Moreover, the FIG. 4 approach also accomplishes the analog to digital conversion of the sensed signal. In more detail, components 140, 142, 144, 146 and 148 cooperate to serve the functions of units 114 and 116 as depicted in FIG. 3. Store 112 is implemented by components 158 and 160. Comparator 118 takes the form of components 154 and 162. Of course, the function of differentiating circuit 182 and its ancillaries is represented by step 120. Metering valve step 122 is achieved by use of components 164 and 166.

Differentiating circuit 182, oscillator 184 and counter 186 constitute a control system for varying the control pulse step width. As specifically embodied in FIG. 2, that is the amount of on-time of either of valves 60 or 62. This circuitry reacts to the slope of its input signal. The steeper the slope, the longer the valve is held open.

It will thus be seen that a system has been disclosed which is capable of being implemented in comparatively simple form insofar as the mechanical components are concerned. In addition, the logic circuitry is of a kind which may utilize integrated circuit components all of which may be mounted upon a comparatively small substrate. The end result of the basic portion of the system is to continually, although incrementally in successive intervals, adjust the fuel/air ratio in a manner which responds to a combustion-produced temperature and which always (except when overridden as described) continues that adjustment in a manner to obtain maximum combustion-produced temperature. The maintenance of that maximum temperature condition insures both maximum fuel economy and minimum undesired emission of combustion products from the exhaust system in that maximized combustion-produced temperature is correlated with maximized combustion.

While a particular embodiment of the invention has been shown and described, and a variety of modifications have been described, it will be obvious to those skilled in the art that changes and modifications may be made without departing from the invention in its broader aspects and, therefore, the aim in the appended claims is to cover all such changes and modifications as fall within the true spirit and scope of the invention.

I claim:

1. In a combustion apparatus having an exhaust system, a fuel supply system and an air supply system, the improvement comprising:

varying means responsive to control information for adjusting in either direction the ratio of fuel to air supplied to said apparatus;

detecting means responsive to the atmosphere within the combustion system for sensing the temperature of the combustion resultant and developing a temperature signal having a value proportional to said temperature;

means for successively comparing a first sample of said temperature signal developed during a first time interval with a second sample of said temperature signal developed during a later time interval to produce said control information and thereby enable said varying means in the direction seeking a maximum of combustion-produced temperature.

2. Apparatus as defined in claim 1 in which said comparing means includes:

means for holding a sample of said temperature signal developed by said detecting means;

means for converting said sample from analog to digital form;

and said comparing means responds to said digital form by producing said control information in incremental steps.

3. Apparatus as defined in claim 1 in which said comparing means includes:

means for holding a sample of said temperature signal developed by said detecting means;

and said comparing means returns a signal to said holding means that maintains status quo thereof when said first and second signals remain the same.

4. Apparatus as defined in claim 1 in which:

said detecting means continuously stores the combustion-produced temperature signal;

there is included means for holding a sample of said temperature signal;

and said comparing means responds to time-displaced ones of said samples.

5. Apparatus as defined in claim 1 in which said varying means adjusts the quantity of air flow to said apparatus from said air supply system.

6. Apparatus as defined in claim 5 which further includes:

pressure means in said fuel supply system for delivering fuel to said apparatus under pressure;

and said varying means includes governing means responsive to said control information for selecting an amount of said pressure to adjust said quantity of air flow.

7. Apparatus as defined in claim 6 in which said pressure means includes a feedback loop from its outlet to its inlet and in which said governing means includes:

a successive pair of valves included in said feedback loop;

operating means for controlling the magnitude of said quantity of air flow;

means coupled to the junction between said valves for driving said operating means;

and means responsive to said comparing means for selectively opening and closing respective ones of said valves to achieve adjustment of said quantity of air flow.

8. Apparatus as defined in claim 1 which further includes means for overriding said comparing means and effecting a predetermined adjustment of said ratio.

9. Apparatus as defined in claim 1 in which said varying means adjusts said ratio in discrete steps.

10. Apparatus as defined in claim 9 in which said comparing means responds to the slope of change of said temperature signal by correspondingly varying the width of said steps.

11. Apparatus as defined in claim 1 in which said detecting means exhibits a predetermined time constant in sensing said temperature and developing said temperature signal, and in which said comparing means operates in accordance with respective ones of said first and later time intervals occurring with a repetition rate to define a period at least approximately equal to said time constant.

12. In a combustion apparatus having an exhaust system, a fuel supply system and an air supply system, the improvement comprising:

impelling means in said fuel supply system for delivering said fuel under pressure;

feedback means for returning fuel along a path from the output to the input of said impelling means;

a successive pair of valves included in said path;

varying means responsive to a pressure condition for adjusting the ratio of fuel-to-air supplied to said apparatus;

means for coupling said varying means to a junction in said path between said valves;

and means responsive to an operating parameter of said apparatus for selectively operating said valves to govern adjustment of said ratio by said varying means.

* * * * *